US009669276B1

(12) United States Patent
Maloy

(10) Patent No.: US 9,669,276 B1
(45) Date of Patent: Jun. 6, 2017

(54) GOLF GREEN DIVOT REPAIR TOOL

(71) Applicant: Evolve Golf, Inc., Wilmington, NC (US)

(72) Inventor: Benjamin J. Maloy, Leland, NC (US)

(73) Assignee: Evolve Golf, Inc., Wilmington, NC (US)

( * ) Notice: Subject to any disclaimer, the term of this patent is extended or adjusted under 35 U.S.C. 154(b) by 0 days.

(21) Appl. No.: 15/164,588

(22) Filed: May 25, 2016

(51) Int. Cl.
*A63B 57/50* (2015.01)
*A63B 57/30* (2015.01)
*A63B 57/20* (2015.01)

(52) U.S. Cl.
CPC ..... *A63B 57/50* (2015.10); *A63B 57/207* (2015.10); *A63B 57/353* (2015.10)

(58) Field of Classification Search
CPC ..... A63B 57/05; A63B 57/207; A63B 57/30; A63B 57/353; A63B 57/50
See application file for complete search history.

(56) References Cited

U.S. PATENT DOCUMENTS

| | | | |
|---|---|---|---|
| 3,456,737 | A | 7/1969 | Rhyme |
| 4,627,621 | A | 12/1986 | Tate |
| 4,984,790 | A | 1/1991 | Dowdy |
| D352,758 | S | 11/1994 | Tate |
| D409,706 | S | 5/1999 | Tate |
| D425,164 | S | 5/2000 | Tate |
| 6,224,502 | B1 | 5/2001 | Warfield |
| 6,290,617 | B1 | 9/2001 | Cole |
| 7,004,858 | B2 | 2/2006 | Bauley |
| 7,238,126 | B1 | 7/2007 | Wiens |
| 7,611,426 | B1 | 11/2009 | Bradshaw |
| D695,864 | S | 12/2013 | Warfield |
| D736,334 | S | 8/2015 | Perry |
| 2003/0032505 | A1 | 2/2003 | Christensen |
| 2003/0148830 | A1 | 8/2003 | Hsiao |
| 2004/0192474 | A1 | 9/2004 | Pietsch |
| 2005/0037873 | A1 | 2/2005 | Kennedy |
| 2007/0093322 | A1 | 4/2007 | Blanks |
| 2007/0111826 | A1 | 5/2007 | Blanks |
| 2008/0268985 | A1 | 10/2008 | Wiens |
| 2010/0113175 | A1 | 5/2010 | Gill |
| 2011/0201456 | A1 | 8/2011 | Schaaf |
| 2013/0095958 | A1 | 4/2013 | Solheim |

*Primary Examiner* — Steven Wong
(74) *Attorney, Agent, or Firm* — Myers Bigel, P.A.

(57) ABSTRACT

A golf green divot repair tool includes a body portion and a single elongate prong attached to the body portion and defining a longitudinal axis. The body portion has opposed upper and lower surfaces, with the upper surface including a thumb pad, the thumb pad defined by an arcuate recess, opposed side walls located on either side of the recess, and a stop located adjacent the prong, the recess, side walls and stop smoothly merging with each other. The prong includes a tip and a shaft, the shaft being attached to the body portion, the shaft including at least two upper faces that merge at a plough edge, the plough edge being centered on the shaft parallel with the longitudinal axis.

14 Claims, 5 Drawing Sheets

GOLF GREEN DIVOT REPAIR TOOL

RELATED APPLICATION

The present application is a continuation application of U.S. patent application Ser. No. 14/618,574, filed Feb. 10, 2015, which claims priority from and the benefit of U.S. Provisional Patent Application No. 61/938,419, filed Feb. 11, 2014, the disclosure of which is hereby incorporated herein in its entirety.

FIELD OF THE INVENTION

The present invention relates generally to golf, and more particularly to repairing ball marks on a green caused by a golf ball.

BACKGROUND OF THE INVENTION

Green repair tools having a ball mark retention function are used by golfers today. Well-known golf accessories for repairing greens including a body having prongs extending therefrom to repair the turf around and in the ball mark depression so as to repair the golf green. The body typically will have a circular recess with a magnetized backing to receive a metallic disc ball marker thereon. Other green repair tools may have a slot in the body through which the marker is inserted, and a finger aperture or opening in the body side that allows the golfer to push the marker up through the slot so as to retrieve the marker therefrom.

SUMMARY OF THE INVENTION

As a first aspect, embodiments of the invention are directed to a golf green divot repair tool, comprising: a body portion; and a single elongate prong attached to the body portion and defining a longitudinal axis. The body portion has opposed upper and lower surfaces, with the upper surface including a thumb pad, the thumb pad defined by an arcuate recess, opposed side walls located on either side of the recess, and a stop located adjacent the prong, the recess, side walls and stop smoothly merging with each other. The prong includes a tip and a shaft, the shaft being attached to the body portion, the shaft including at least two upper faces that merge at a plough edge, the plough edge being centered on the shaft parallel with the longitudinal axis.

As a second aspect, embodiments of the invention are directed to a golf green divot repair tool, comprising: a body portion; and a single elongate prong attached to the body portion and defining a longitudinal axis. The body portion has opposed upper and lower surfaces, with the upper surface including a thumb pad, the thumb pad defined by an arcuate recess, opposed side walls located on either side of the recess, and a stop located adjacent the prong, the recess, side walls and stop smoothly merging with each other. The prong includes a tip and a shaft, the shaft being attached to the body portion, the shaft including at least two upper faces that merge at a plough edge, the plough edge being centered on the shaft parallel with the longitudinal axis, the shaft further including opposed side walls that are substantially parallel with each other.

As a third aspect, embodiments of the invention are directed to a golf green divot repair tool, comprising: a body portion; and a single elongate prong attached to the body portion and defining a longitudinal axis. The body portion has opposed upper and lower surfaces, with the upper surface including a thumb pad, the thumb pad defined by an arcuate recess, opposed side walls located on either side of the recess, and a stop located adjacent the prong, the recess, side walls and stop smoothly merging with each other. The repair tool further comprises a golf ball marker with a post, the golf ball marker attached to the body portion via the post being inserted into an aperture located on the lower surface of the body portion beneath the stop.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used herein is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Referring now to the figures, a golf green repair tool, designated broadly at 20, is shown in FIGS. 1-10. The tool 20 includes generally a body portion 22 and a single elongate prong 24. These structures are described in detail below.

Figure 8:
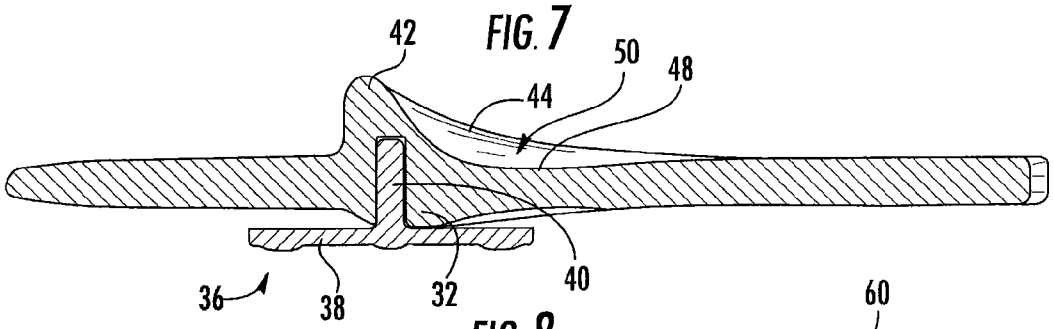
FIG. 8 is a section view of the repair tool of FIG. 1 taken along lines A-A of FIG. 2.
Figure 9:
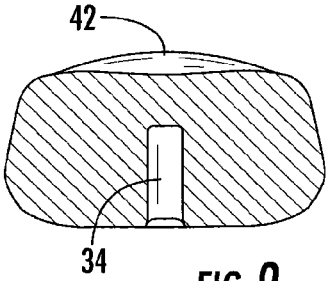
FIG. 9 is a section view of the repair tool of FIG. 1 taken along lines B-B of FIG. 3.

The body portion 22 includes opposed upper and lower surfaces 26, 28. As can be seen in FIG. 8, the lower surface 28 has a depression 30 near one end thereof and a projection 32 adjacent the depression 30. An aperture 34 extends upwardly from the projection 32. A golf ball marker 36 having a disk 38 and a post 40 is attached to the body portion 22 via the post 40 being inserted into the aperture 34.

Figure 1:
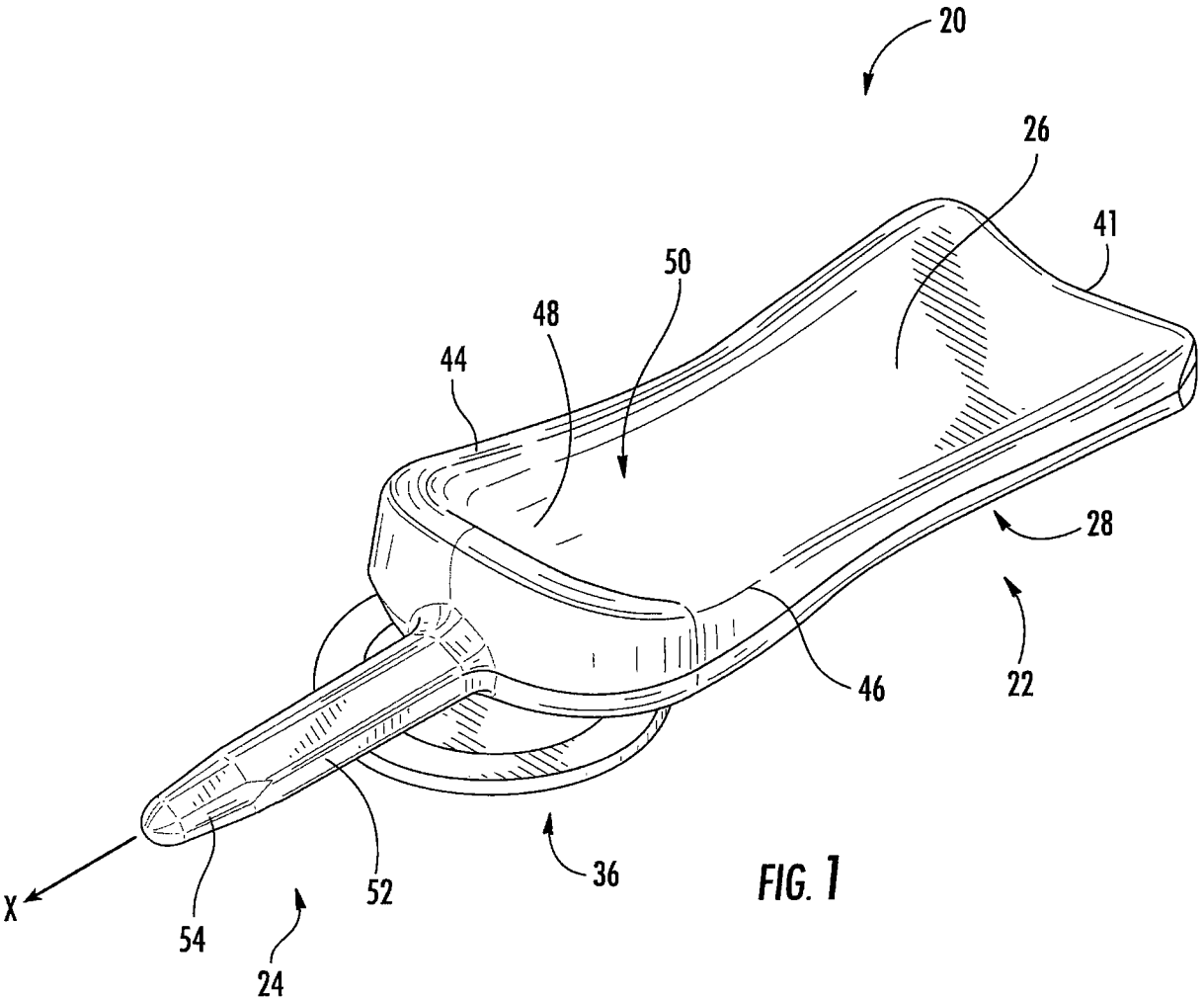
FIG. 1 is a perspective view of a golf green divot repair tool according to embodiments of the present invention.
Figure 2:
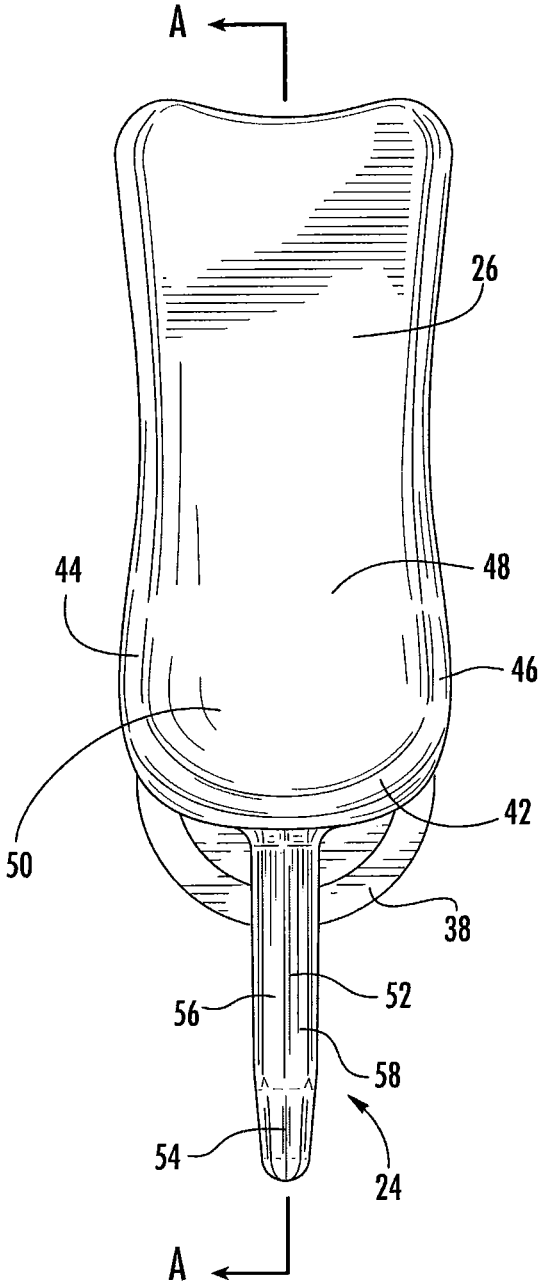
FIG. 2 is a top view of the repair tool of FIG. 1.
Figure 3:
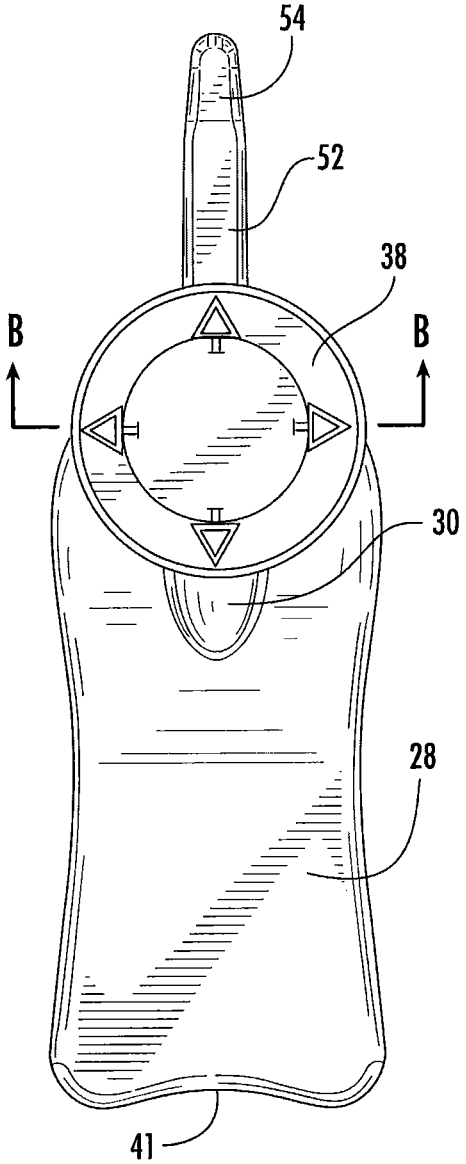
FIG. 3 is a bottom view of the repair tool of FIG. 1.
Figure 4:
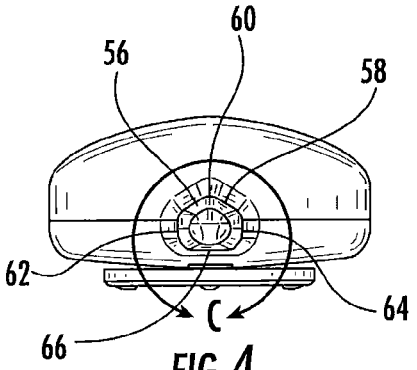
FIG. 4 is a front view of the repair tool of FIG. 1.
Figure 5:
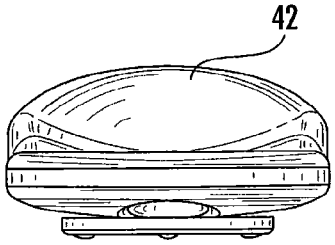
FIG. 5 is a rear view of the repair tool of FIG. 1.
Figure 6:
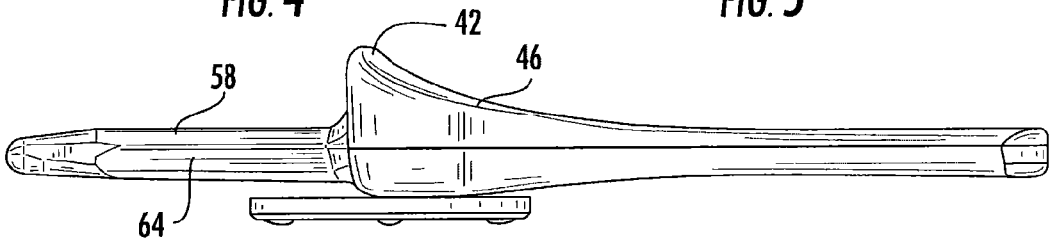
FIG. 6 is a side view of the repair tool of FIG. 1.
Figure 7:
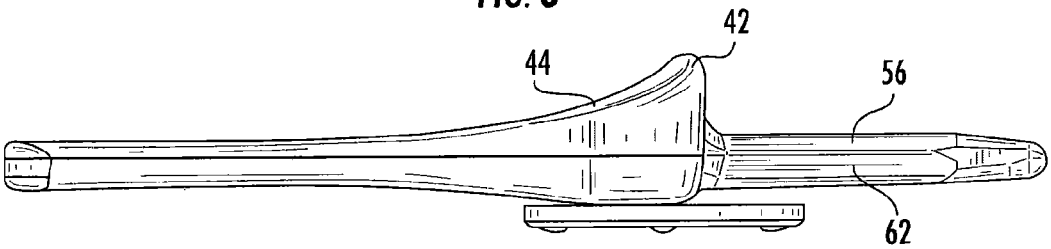
FIG. 7 is an opposite side view of the repair tool of FIG. 1, with the ball marker removed.

The upper surface 26 of the body portion 22 has a sloped stop 42 that is generally above the projection 32. Opposed side walls 44, 46 extend rearwardly from the stop 42. An arcuate recess 48 is bounded by the stop 42 and the side walls 44, 46. As seen in FIGS. 5 and 8, the stop 42 and the side walls 44, 46 merge smoothly with the recess 48 to define a thumb pad 50 configured to receive the thumb of a user. An indentation 41 is present at the end of the body portion 22 opposite the stop 42. The sides of the body portion 22 are slightly concave to promote proper gripping of the tool 20.

Figure 10:
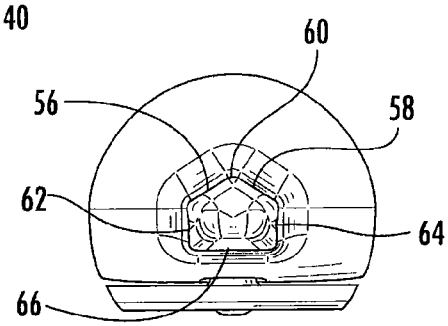
FIG. 10 is an enlarged partial view of the repair tool of FIG. 1 showing the inset C denoted in FIG. 4.

The prong 24 includes a shaft 52 and a tip 54. As can be seen in FIGS. 5 and 10, the prong 24 is generally pentagonal in cross-section, including five faces: two angled upper faces 56, 58 that merge at a slightly rounded plough edge 60, two opposed, substantially parallel side faces 62, 64, and a bottom face 66. The tipper faces 56, 58 define a plough angle of between about 100 and 140 degrees. The base end of the shaft 52 is attached to the body portion 22 adjacent the stop 42. It can also be seen in FIGS. 2, 3 and 10 that the shaft 52 is tapered (typically at an angle of 5 degrees or greater, and in some embodiments as much as 20 or 25 degrees or more) such that a narrows as it extends away from the stop 42. The tip 54 is attached to the opposite end of the shaft 52 and tapers further to, a generally rounded end. The prong 24 defines a longitudinal axis A. The axis A is positioned such that the thumb pad 50 is centered thereon.

Figure 11:
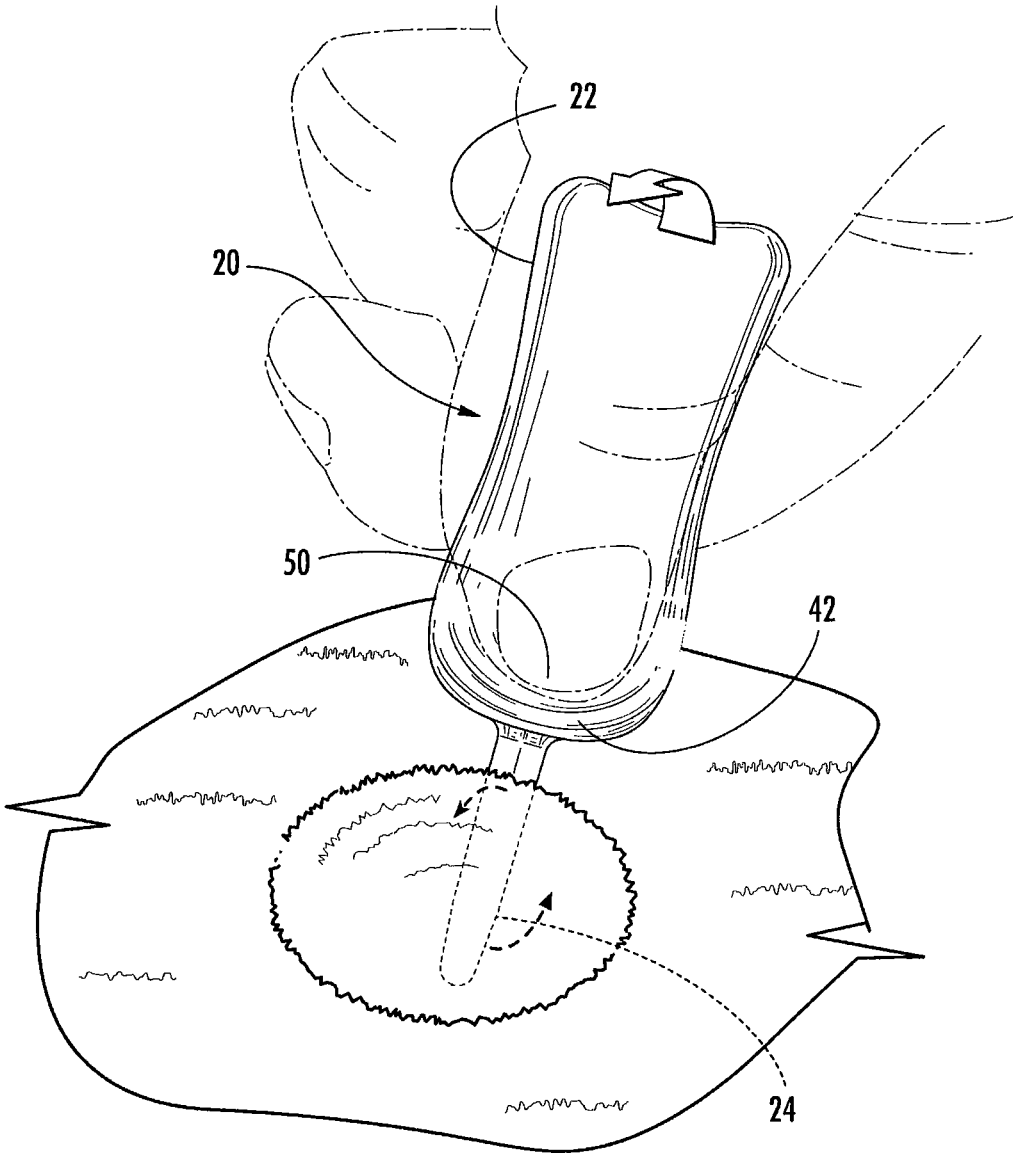
FIG. 11 is a side view illustrating how the repair tool of FIG. 1 can be grasped for use in repairing a golf green divot.

When a user wishes to repair a divot formed by a golf ball on a putting green, the user grasps the tool 20 with his thumb on the thumb pad 50 and his index finger (and perhaps additional fingers) under the lower surface 28 of the body portion 22. The recess 48 in the thumb pad 50 ergonomically positions the user's thumb, and the stop 42 provides a structure that can prevent the thumb from slipping toward the prong 24 (see FIG. 11). The user's fingers wrap around and underneath the body portion 22, with their positioning encouraged by the concave profile of the sides of the body portion 22. Typically the ball marker 36 is removed from the aperture 34 for divot repair, with its removal facilitated by the presence of the depression 30.

The tool 20 is inserted adjacent the divot with the prong 24 extending at an angle beside and, to a certain extent, underneath the divot. The insertion angle may be between about 30 and 90 degrees, but is typically between about 45 and 60 degrees. The body portion 22 of the tool 20 is then forced toward the divot. This motion is encouraged by the positioning of the user's thumb on the thumb pad 50 directly above the base of the prong 24. Conversely, incorrect motions (such as forcing the body portion 22 away from the divot, such that the prong 24 is lifting toward the divot in a digging motion) are discouraged by the positions of the thumb and the fingers wrapped underneath the body portion 22.

The shape of the shaft 52 of the prong 24, and in particular the plough edge 60 present between the upper faces 56, 58, and the plough angle formed by the upper faces, helps to raise the soil without tearing the roots of the grass when inserted into the ground at an angle from outside the divot and moved toward the bottom of the divot. Moreover, the plough edge 60 can help to loosen, and thereby aerate, the soil compacted by the divot. Similarly, the taper in the shaft 52 can assist in providing a "ploughing" action that helps to aerate the soil.

Figure 12:
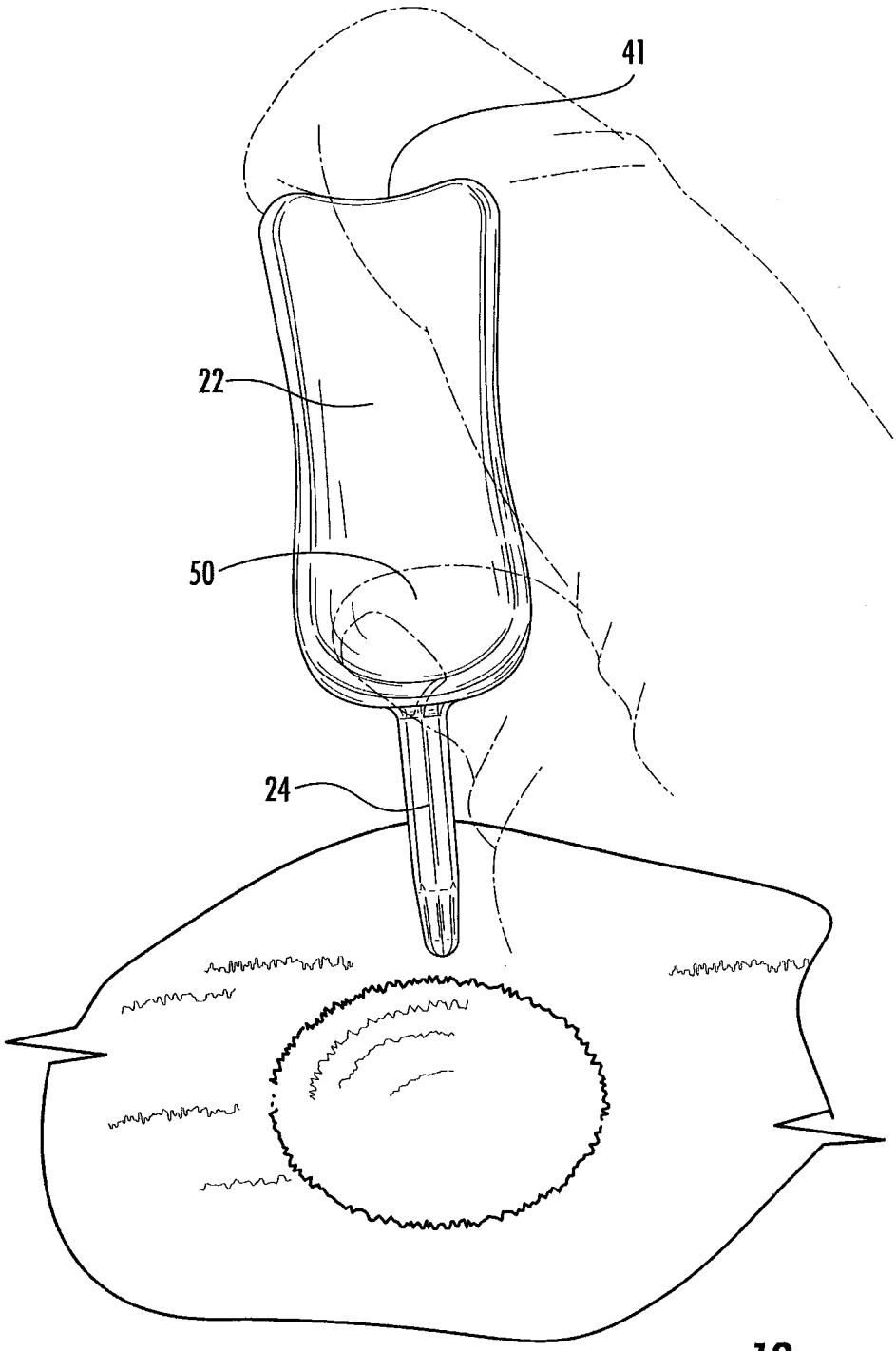
FIG. 12 is a front view illustrating how the repair tool of FIG. 1 can be grasped for use in repairing the far side of a golf green divot.

As shown in FIG. 12, the tool 10 may also be used easily to repair the far side of a divot. The user can place his thumb on the thumb pad 50 and the knuckle of his index finger over the indentation 41 in the body portion 22, then insert the prong 24 into the ground adjacent the far side of a divot and pull the body portion 22 toward himself. This action will repair in the divot in the proper fashion without tearing the root system as discussed above.

The tool 20 is typically formed as a monolithic component, and may be formed by injection molding. Exemplary materials for the tool 20 include conventional thermoplastics such as nylon and ABS, biocomposite materials, and metals.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A golf green divot repair tool, comprising:

a body portion; and a single elongate prong attached to the body portion and defining a longitudinal axis;

wherein the body portion has opposed upper and lower surfaces, with the upper surface including a thumb pad, the thumb pad defined by an arcuate recess, opposed side walls located on either side of the recess, and, a stop located adjacent the prong, the recess, side walls and stop smoothly merging with each other;

wherein the prong includes a tip and a shaft, the shaft being attached to the body portion, the shaft including at least two upper faces that merge at a plough edge, the plough edge being centered on the shaft parallel with the longitudinal axis;

wherein the shaft is generally pentagonal in cross-suction, and wherein the shaft includes opposed side walls, and wherein the side walls are substantially parallel with each other.

2. The repair tool defined in claim 1, wherein the tip includes multiple faces.

3. The repair tool defined in claim 1, wherein the shaft tapers from end to end, with a narrower end being adjacent the tip.

4. The repair took defined in claim 1, wherein the thumb pad is centered on the longitudinal axis.

5. The repair tool defined in claim 1, wherein the side walls of the thumb pad are tapered in the axial direction.

6. The repair tool defined in claim 1, wherein the lower surface of the body portion includes a depression directly beneath the thumb pad.

7. The repair tool defined in claim 1, further comprising a golf ball marker attached to the body portion.

8. The repair tool defined in claim 7, wherein the golf ball marker includes a post, and wherein the post is inserted into an aperture located on the lower surface of the body portion beneath the stop.

9. A golf green divot repair tool, comprising:

a body portion; and a single elongate prong attached to the body portion and defining a longitudinal axis;

wherein the body portion has opposed upper and lower surfaces, with the upper surface including a thumb pad, the thumb pad defined by an arcuate recess, opposed side walls located on either side of the recess, and a stop located, adjacent the prong, the recess, side walls and stop smoothly merging with each other;

wherein the prong includes a tip and a shaft, the shaft being attached to the body portion, the shaft including at least two upper faces that merge at a plough edge, the plough edge being centered on the shaft parallel with the longitudinal axis, the shaft being generally pentagonal in cross-section and further including opposed side walls that are substantially parallel with each other, and wherein the shaft tapers from end to end, with a narrower end being adjacent the tip.

10. The repair took defined in claim 9, wherein the thumb pad is centered the longitudinal axis.

11. The repair tool defined in claim 9, wherein the side walls of the thumb pad are tapered in the axial direction.

12. The repair tool defined in claim 9, wherein the lower surface of the body portion includes a depression directly beneath the thumb pad.

13. The repair tool defined in claim 9, further comprising a golf ball marker attached to the body portion.

14. The repair tool defined in claim 13, wherein the golf ball marker includes a post, and wherein the post is inserted into an aperture located on the lower surface of the body portion beneath the stop.

* * * * *